United States Patent [19]

Castillo

[11] 4,104,962

[45] Aug. 8, 1978

[54] PRESS

[75] Inventor: Adolfo Castillo, Miami, Fla.

[73] Assignee: Automabed Building Components, Inc., Miami, Fla.

[21] Appl. No.: 777,090

[22] Filed: Mar. 14, 1977

[51] Int. Cl.[2] ..... B30B 1/32

[52] U.S. Cl. ..... 100/100; 100/DIG. 13; 100/271; 227/152; 269/321 F

[58] Field of Search ..... 100/257, 100, 258 A, 100/269 R, 270, 271, 276, 283, DIG. 13; 144/288 C; 227/152; 269/321 F

[56] References Cited

U.S. PATENT DOCUMENTS

| | | | |
|---|---|---|---|
| 2,224,968 | 12/1940 | Klocke | 100/271 |
| 3,238,867 | 3/1966 | Jureit et al. | 100/DIG. 13 |
| 3,603,244 | 9/1971 | Jureit et al. | 100/DIG. 13 |
| 3,750,562 | 8/1973 | Jureit | 100/DIG. 13 |
| 3,805,694 | 4/1974 | Jureit et al. | 100/271 |

*Primary Examiner*—Billy J. Wilhite
*Attorney, Agent, or Firm*—LeBlanc & Shur

[57] ABSTRACT

A press which is suitable for use in fabricating wooden trusses is disclosed, wherein the press includes a lower stationery press platen and an upper moveable press platen opposing the lower press platen. Bellcranks are mounted on the lower press platen supporting structure on opposite sides of the press. A transfer bar interconnects the upper ends of the bellcranks. A hydraulic cylinder connects the moveable, upper press platen and a bellcrank. Guide rods are provided to guide the moveable upper press platen during vertical movement above the lower press platen.

The press exerts substantial pressures upon the trusses or the like being pressed between the platens, while maintaining the platens in a generally parallel relationship, in spite of uneven press loading.

12 Claims, 17 Drawing Figures

PRESS

BACKGROUND OF THE INVENTION

The present invention relates to a novel and improved press and particularly relates to a press of the type useful for embedding toothed connector plates into the joints of wooden trusses and the like.

The building construction industry has recently made tremendous strides forward with the advent of prefabricated wooden trusses, panels, and the like. Such trusses comprise wooden framing members, in most cases, fastened together at their joints by nail plates, for example, of the type disclosed in U.S. Pat. No. 2,877,520 of common assignee herewith. A number of methods for applying the nail plates to the butt joints, such as hand nailing, utlizing individual power-operated presses at each joint, etc., have variously proven time-consuming, laborious, expensive, and not susceptible to large-scale automated truss fabrication techniques.

Truss fabrication techniques have advanced to the state where power-operated presses for embedding the nail plates into the joints of the wooden frame members are utilized. One such truss fabrication technique provides for the prepositioning of the frame member on a jig table in the pattern of the truss with the connector plates spotted on opposite sides of the joints of such members. Thereafter, the connector plates are pressed into the joints to fasten the frame members together and form a completed truss, panel, or the like. Presses capable of providing the foregoing action are disclosed in U.S. Pat. Nos. 3,079,607 and 3,195,449 of common assignee herewith.

In U.S. patent application Ser. No. 867,730, filed Oct. 20, 1969 now U.S. Pat. No. 3,603,244 dated Sept. 7, 1971, of common assignee herewith, there is disclosed a toggle-actuated press mounted for movement along a track and a control system for periodically stopping the press in a pressing position with the press platen located over the connector plates of the joints of the wooden members. The press of that application is disclosed more fully in U.S. Pat. No. 3,520,252, issued July 14, 1970, also of common assignee herewith. While the press disclosed in that application and patent has operated satisfactorily, particularly where the loadings across the press are substantially uniform, asymmetrical loadings have caused problems. Asymmetrical loadings are caused by the differences in location of the joints of the various types and sizes of trusses. Further, in those presses which mount fluid-actuated cylinders at their opposite ends, for example, the presses disclosed in U.S. Pat. Nos. 3,079,607 and 3,195,449, only the cylinder or the cylinders at one end of the press are generally effective with respect to the eccentric load. Consequently, these presses are limited in capacity when subjected to asymmetrical loadings to substantially the capacity of the cylinder or cylinders at one end of the press.

In U.S. Patent Application Ser. No. 190,724, filed Oct. 20, 1971, now U.S. Pat. No. 3,750,562, dated Aug. 7, 1973 of common assignee herewith, there is disclosed a press having a fluid actuated cylinder at each end of the press and connecting between the press base and the press head, with suitable guides provided at opposite ends of the press. When the press is subjected to asymmetrical loadings, the unused pressing capacity at one end of the press is transferred to its opposite end to provide a uniform loading along the entirety of the press by use of a load transfer apparatus. The load transfer apparatus interconnects the opposite ends of the press and includes at each end a bell crank pivotably mounted to the base and a pair of rods pivotably connected at opposite ends to the bell crank and to the moveable press head. A transfer bar interconnects the bell cranks at opposite ends of the press. When asymmetrical loadings are encountered, the force applied by the cylinder at the unloaded or partially loaded end of the press is transferred to the loaded end through the rod, bell cranks and transfer bar.

SUMMARY OF THE INVENTION

The present invention is directed to a press which is suitable for use in fabricating wooden panels, roofs and floor trusses and the like. The press includes

- a press structure including a first press platen,
- a head including a second press platen in opposition to said first press platen,
- at least two bellcrank means mounted upon said base structure on opposite sides of said press,
- a transfer bar means interconnecting said bellcrank means,
- a fluid actuated cylinder means connecting said head and a bellcrank means and
- guide means for guiding said second press platen during generally vertical movement in relation to said first press platen, said bellcrank means, said transfer bar means, said cylinder means and said guide means cooperating to move said second press platen means in the desired generally vertical direction in relation to said first press platen means while maintaining said platen means in a generally parallel relationship.

A preferred embodiment of the present invention is directed to a method of clamping the wooden trusses or the like which are being pressed against transverse movement thereof, and the clamping is accomplished by use of an air clamp wherein a pneumatic cylinder rotates one end of a toggle about a pivot point, to restrain or free the wooden members being pressed. When the air clamp is in position to restrain the wooden members, a direct mechanical linkage is provided between a stationery point on the press jig table and the portion of the air clamp which contacts the wooden members or jig tubes or the like. This avoids a situation wherein lateral stresses arising from the pressing operation are resisted directly by the pneumatic or other fluid-actuated cylinder.

DETAILED DESCRIPTION OF THE INVENTION

The present invention will be more readily understood by reference to the attached drawings, wherein.

FIGS. 14 A, B, C, and D are schematic overhead views of the jig table and press, showing the press is various stages of operation during various stages of truss assembly.

Figure 1:
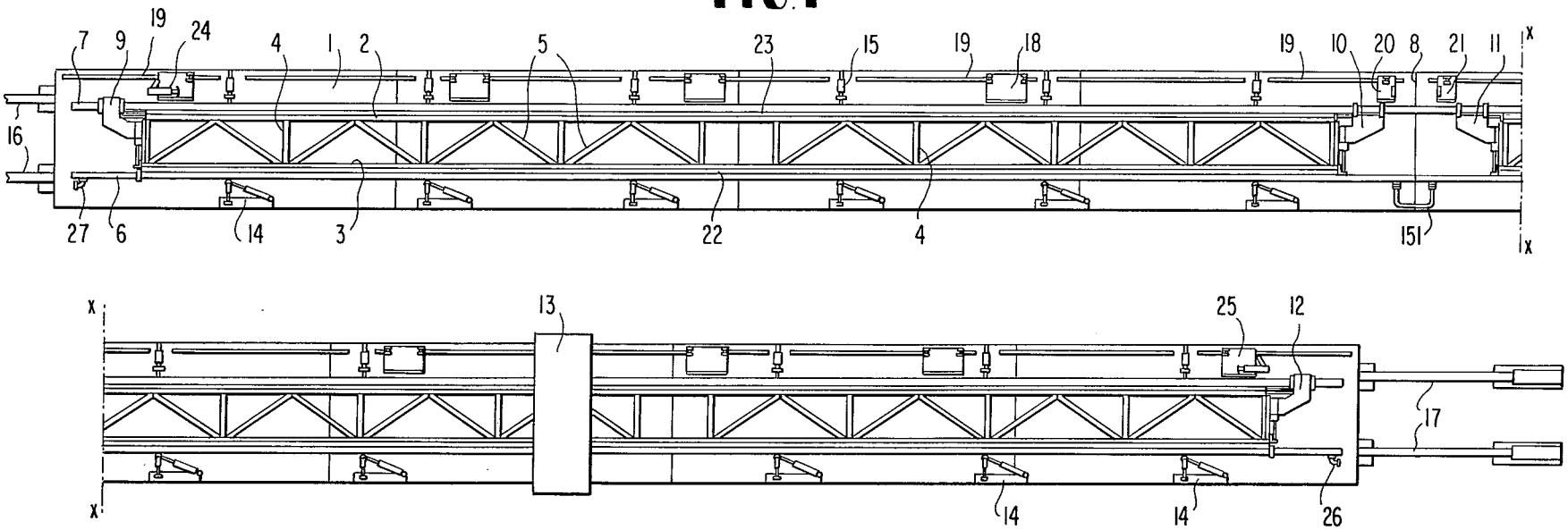
FIG. 1 is an overhead view of the jig table of the present invention, with the press of the present invention schematically indicated thereon.

In FIG. 1, jig table 1 is illustrated in a stage of fabrication of a wooden truss from longitudinal members 2, 3, perpendicular bridging members 4 and diagonal bracing members 5. The truss assembly is held on the jig table between jig tubes 6, 7. Two different trusses are shown, one on either side of jig table centerline 8. Each truss is clamped between end locator clamps 9, 10 and 11, 12.

Press 13 is schematically shown as moving along the right-hand section of jig table 1. Jig tube 6 is held against horizontal movement on the jig table 1 during the pressing operation by air clamp 14 and jig tube 7 is similarly held by camber adjustment assembly 15.

The jig table is supported on either end by jig supports 16, 17. Splice pads 18 are located on tracks 19 along the camber adjustment side of jig table 1. Stop pads 20, 21 are located on sections of track 19 adjacent the jig table centerline 8. Between longitudinal member 3 and jig tube 6 is a second longitudinal member 22 which is being assembled for use in a truss which is to be subsequently fabricated. Likewise, between longitudinal member 2 and jig tube 7 is a second longitudinal member 23, which will be used in a truss which is to be subsequently fabricated. At either end of jig table 1 a clamp pad 24, 25 is located on a rail 19. Compressed air is supplied to the interior of jig tube 6 through air fittings 26, 27.

Figure 2:
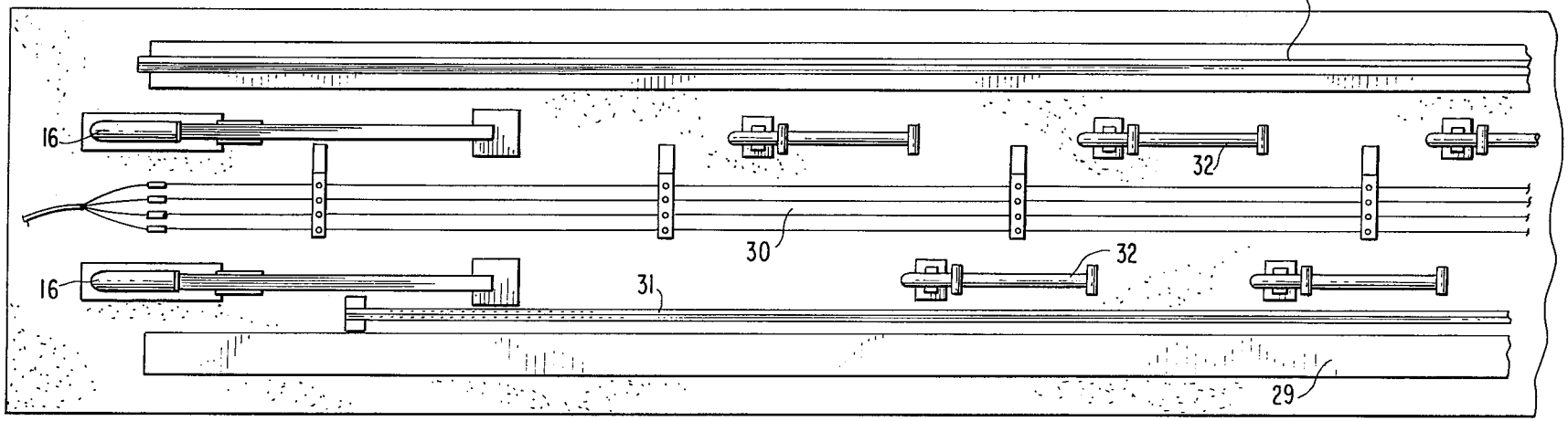
FIG. 2 is an overhead view of the jig table accessories located underneath the jig table.

The jig table accessories located underneath jig table 1 are illustrated in FIG. 2. Press 13 moves on wheels along angle track 28 and flat track 29. Bus bars 30 supply electrical power to the press without requiring overhead wiring.

Automatic switch assembly stop pegs are received in perforated angle stop member 31. The jig table 1 is supported by end supports 16, 17 at each end, and by flip-flop legs 32 at intermediate locations. Flip-flop legs 32 are designed, as will be explained hereinbelow, to allow the press to pass freely from one end to the other end of jig table 1. Flip-flop leg 32 is pivoted about floor-mounted pivot 48, and has an end 49 and an opposite end 50.

Figures 3, 4:
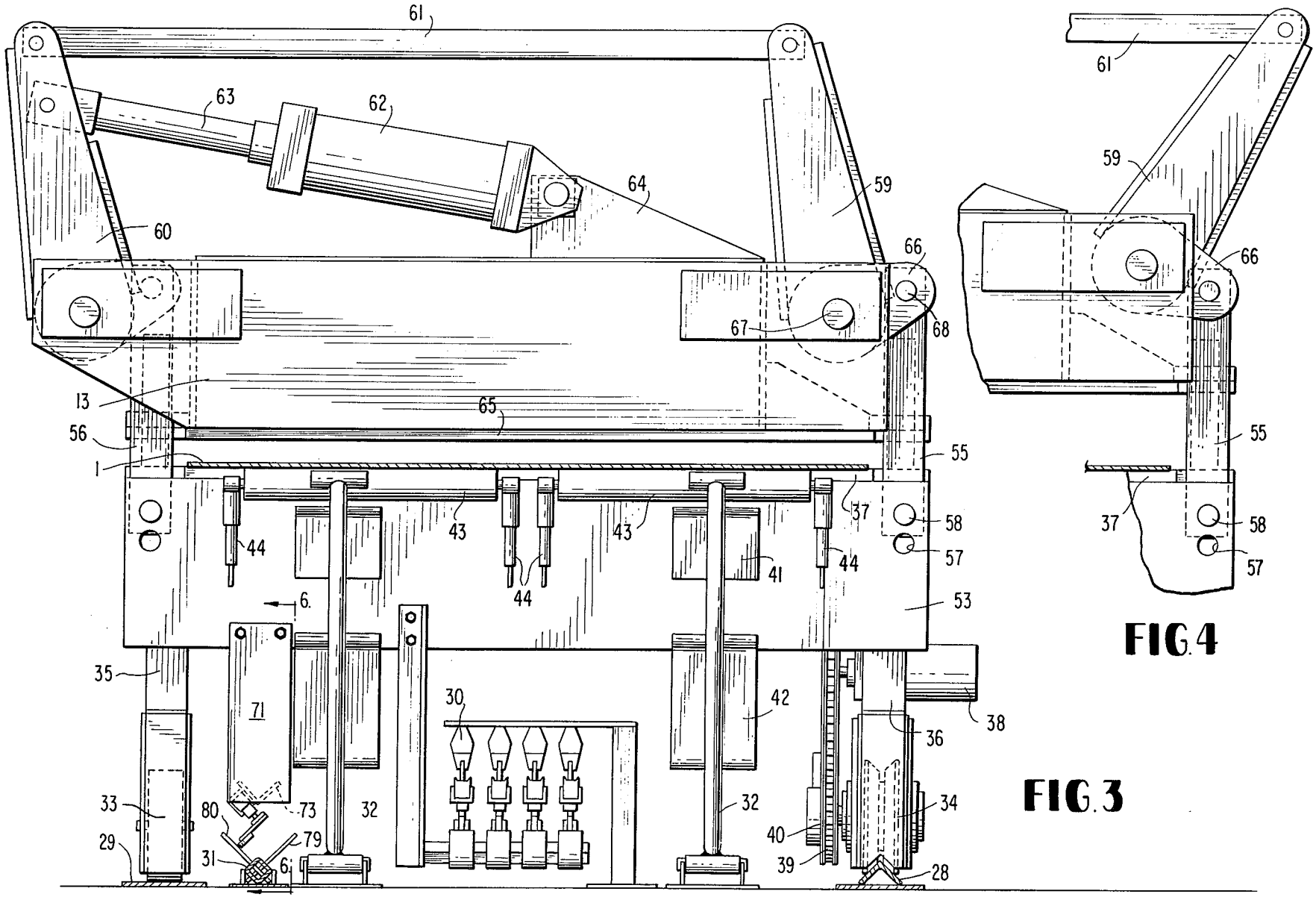
FIG. 3 is an end view of the bell crank press of the present invention, illustrated in its down or pressing position, and a cross-sectional view of the jig table.
FIG. 4 is a partial end view of the bell crank press of the present invention, similar to the view of FIG. 3 but with the press in the up position.
Figure 5:
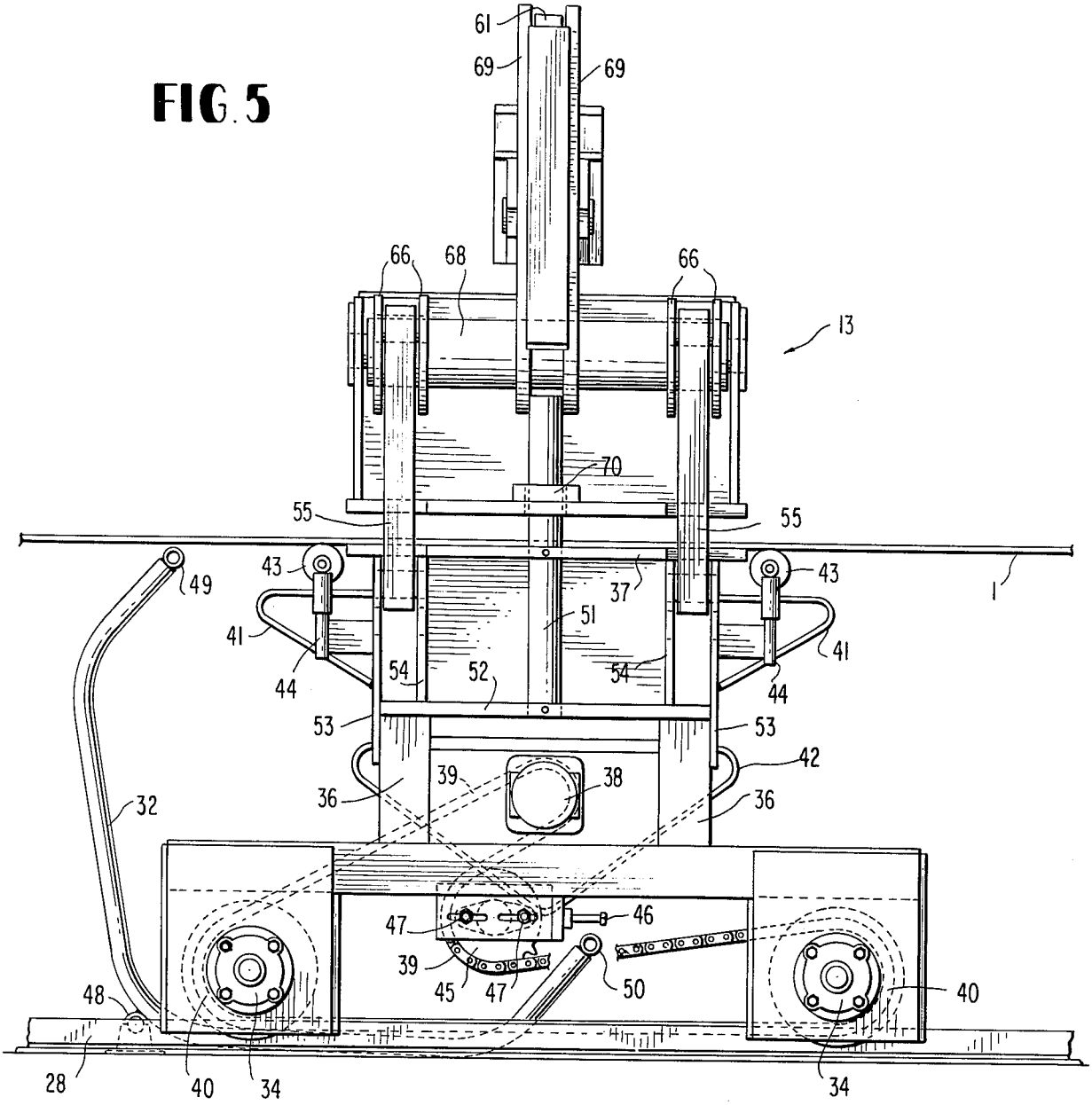
FIG. 5 is a side view of the bell crank press and the jig table of the present invention.

In FIGS. 3, 4 and 5, press 13 surrounds jig table 1. The jig table, shown in an intermediate location of press travel, is supported by flip-flop legs 32, which are pivotably mounted on the floor beneath the jig table.

Press 13 travels along the jig table 1 on flat wheels 33 and angled wheels 34, which travel on flat track 29 and angle track 28, respectively. The wheels are connected through their respective axles to support legs 35, 36, which are in turn connected to and support lower press platen 37. Motor 38 mounted upon supported leg 36 drives wheel 34 through chain 39 and sprocket 40. Guide plates 41 and 42 serve to guide the flip-flop legs 32 to cause the legs to move from a position wherein the jig table 1 is supported by a given end of leg 32 to a position wherein the support is furnished by the opposite end of leg 32.

The jig table 1 is supported on either side of press 13 by rollers 43, which are mounted upon spring loaded supports 44. During pressing operation, the spring loaded support allows the rollers 43 to retract out of the way so that they will not interfere with the pressing operation.

Chain 39 passes over idler sprocket 45 as well as over motor 38 and the sprockets 40 of the pair of angle wheels 34. Idler sprocket 45 has an adjustment screw 46, and adjustable mounting bolts 47, to enable the chain 39 to be placed under the proper tension.

A guide member 51 is mounted upon lower press platen 37 and member 52 extending between a pair of support legs 36. Support plates 53 and 54, mounted between each pair of support legs 35, 36, support links 55, 56. A pair of mounting holes 57, 58 permit each link 55, 56 to be adjustable in height relative to the lower press platen 37, thus permitting the press to handle a range of material thickness. Bellcranks 59, 60 are pivotably mounted at the top ends of links 55, 56 and the upper ends of bellcranks 59, 60 are connected by transfer bar 61. A fluid-actuated cylinder 62 and a piston 63 reciprocal therein is privotably connected at one end thereof to the upper portion of a bellcrank 60, and pivotably connected at the other end thereof to a flange 64 which is ridigly connected to upper press platen 65.

As will be more clearly seen in FIG. 5, each bellcrank 59, 60 comprises two pairs of lower bellcrank lobes 66 rigidly mounted on axle 67 and pivotably mounted on axle 68 located in bellcrank support members 55, 56. Axle 67 extends across press 13, and has a pair of upper bellcrank lobes 69 rigidly attached thereto. The upper bellcrank lobes 69 are in turn pivotably mounted to transfer bar 61.

Guide member 51 passes through bronze grease bushing 70 in upper press platen 65.

Figure 6:
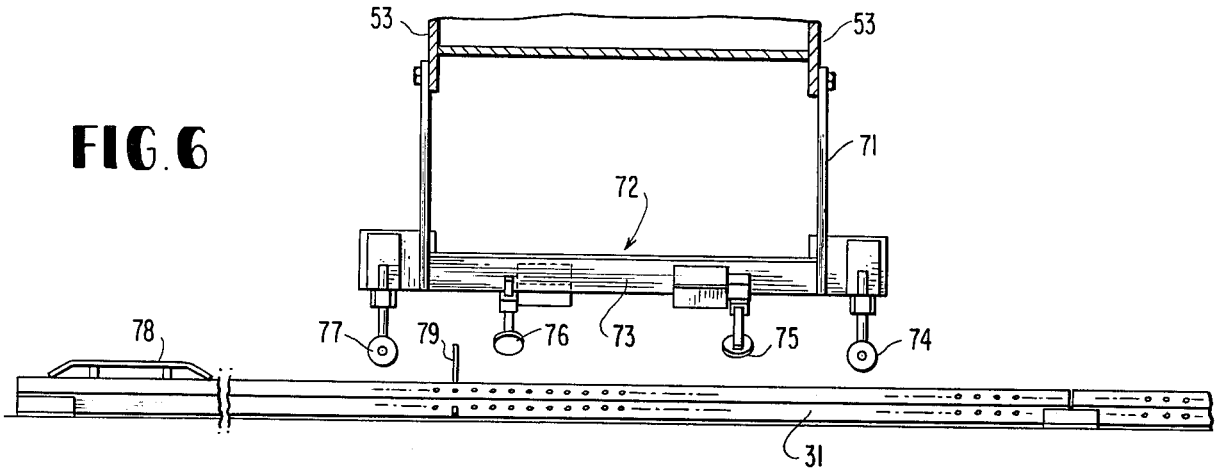
FIG. 6 is a side view of the automatic switch assembly and associated stops of the jig table.

The automatic pressing capability of the press of the present invention will be more clearly understood with reference to FIGS. 3 and 6, wherein the automatic switch assembly is illustrated. Switch assembly mounting plates 71 are bolted to the plates 53, and carry the automatic switch assembly 72. Switch assembly 72 comprises an angle-shaped mounting plate 73 and four contact arms 74, 75, 76 and 77. The automatic switch assembly 72 functions in connection with perforated angle stop member 31, having a stop plate 78 at either end thereof. A plurality of stop pegs 79, 80 can be inserted in predetermined locations through perforated angle stop member 31. Contact arm 75 contacts stop peg 80, and contact arm 76 contacts stop peg 79, to permit the press to sense various predetermined locations of its path of travel. Contact arm 77 contacts stop plate 78 when the press has reached one end of the jig table, and serves to stop the press from further travel in that direction. Contact arm 78 contacts a similar stop plate (not shown) at the opposite end of the jig table, to prevent further travel in that direction.

Figure 7:
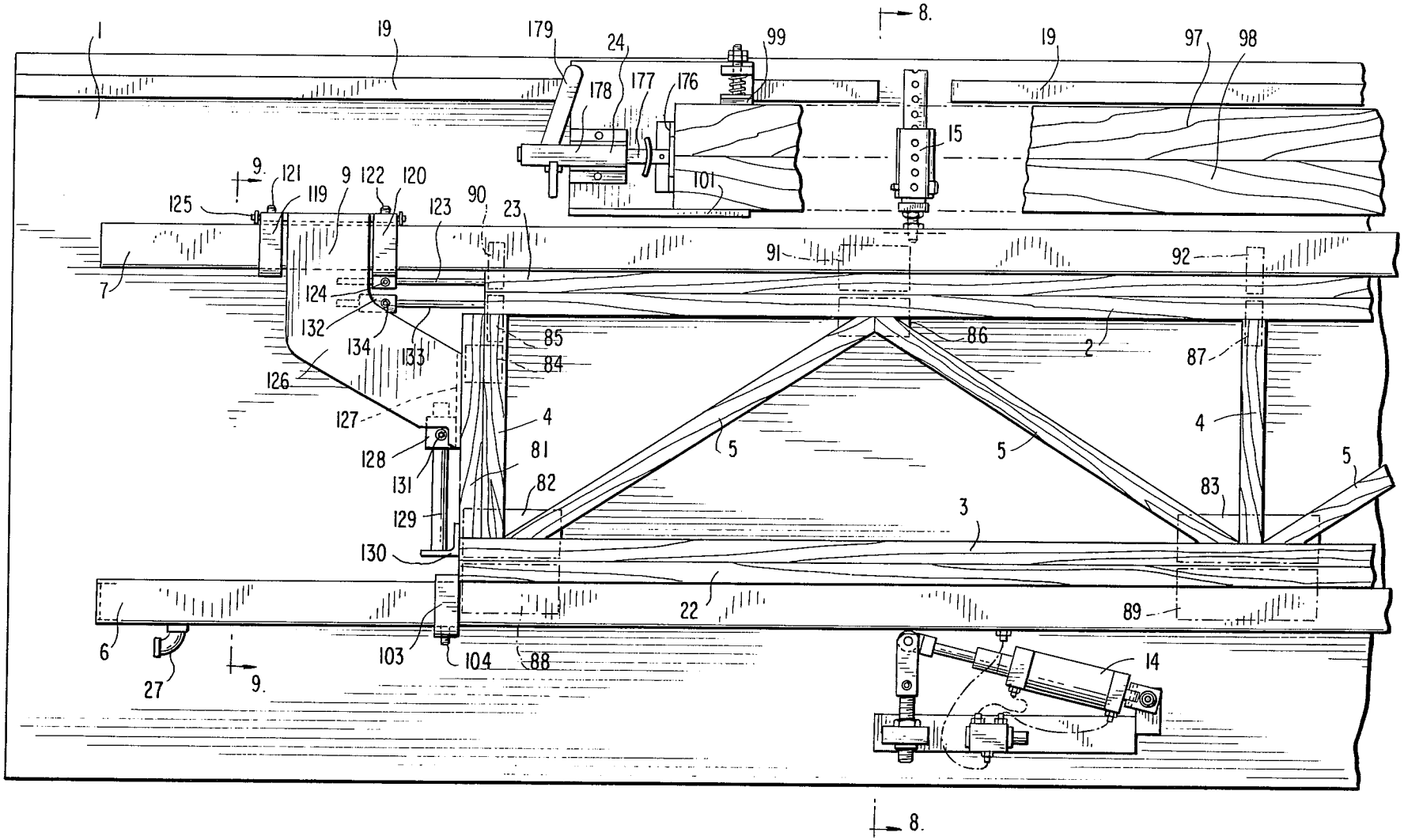
FIG. 7 is an overhead view of one end of the jig table, illustrating the end and side clamping devices.

FIG. 7 is an overhead enlarged view of the left-hand end of the jig table 1 of FIG. 1. A truss is being assembled from longitudinal members 2, 3, perpendicular members 4 and diagonal members 5. An end member 81 is located at either end of the truss. The truss is assembled by pressing therein a series of connector plates on each side of the truss. Connector plates 82 and 83 are located between longitudinal member 3 and jig table 1 and were pressed into longitudinal member 3 in an earlier pressing operation, as will be more clearly described hereinbelow. Likewise, connector plates 85, 86 and 87 are located between longitudinal member 2 during an earlier pressing operation. Connector plate 84 is located beneath end member 81 and a perpendicular member 4.

Figure 8:
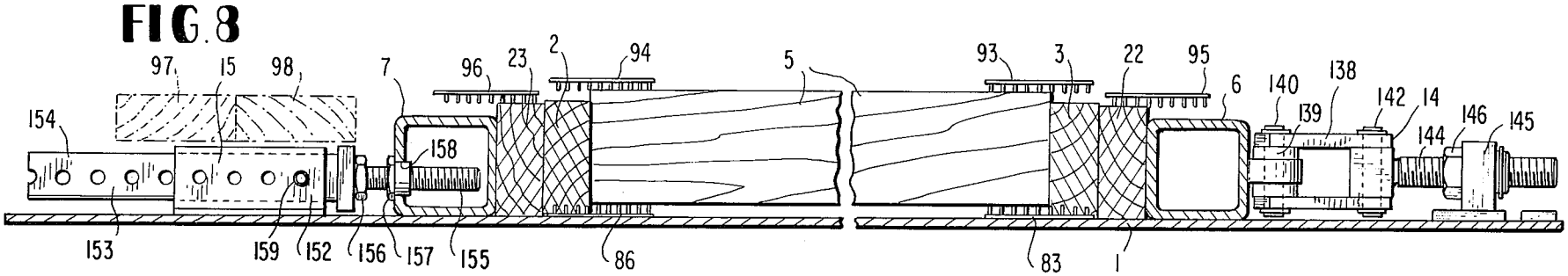
FIG. 8 is a cross-sectional view, along line 8—8 of FIG. 7, of the camber adjustment means, the jig table, the air clamp, and the wooden truss being fabricated.

In order to press connector plates into longitudinal member 22, for use in a subsequent truss assembly pressing operation, connector plates will be placed over the areas 88, 89, 90, 91 and 92, shown in dotted outline. One end of the connector plates placed over these areas will be pressed into either longitudinal member 22 or longitudinal member 23. As will be noted in FIG. 8, connector plate 93 has been placed over connector plate 83, and connector plate 94 has been placed over connector plate 86. Similarly, connector plates will be placed on the upper side of the truss assembly over connector plates 87, 85 and 82. FIG. 8 also illustrates toothed connector plates 95, 96 placed over connector plate areas 89, 91, respectively.

While a truss is being assembled, longitudinal members are being formed from shorter pieces of lumber 97, 98 at one side of jig table 1. A plurality of pieces of lumber 98 are butted together and joined by toothed connector plates to form a longitudinal member, and a similar longitudinal member is formed from pieces of lumber 97. Pieces of lumber 97, 98 are retained, spaced from but adjacent to jig tube 7, in the longitudinal direction by stop pad 20 and clamp pad 24, and in the transverse direction by splice pads 18 and spring-loaded clamping elements 99 and 100 of clamp pad 24 and stop pad 20, respectively. Upwardly extending flange 101 on clamp pad 24 and corresponding flange 102 on stop pad 20 also aid in retaining lumber pieces 97, 98 in the transverse direction.

Longitudinal member 22 is restrained against longitudinal movement by clamp 103, retained on jig tube 6 by set screw 104, at one end, and on the other end by end clamp 10. End clamp 10 is clamped into position on jig tube 7 by clamps 105, 106 respectively held by set screws 107, 108. End clamp 10 has a fixed restraining face 109 bearing against end piece 81 and adjustable restraining face 110 bearing against the ends of longitudinal members 3, 22. Adjustable restraining face 110 is attached to arm 111 received in sleeve 112 and retained therein by set screw 113. End clamp 10 also includes a second adjustable restraining face 114, affixed to arm 115 which is received in sleeves 116, 117 and retained therein by set screw 118.

The truss which is being assembled is retained at the extremities of the jig table 1 by end clamps 9, 12. These clamps are mirror images of each other, and end clamp 9, for instance, is pivotably affixed to jig tube 7 by clamps 119, 120, which are retained on jig tube 7 by set screws 121, 122. Arm 123 is adjustably fixed on clamp 120 by set screw 124, and retains longitudinal member 23. The remainder of end clamp 9 is pivotably affixed to clamps 119, 120 by pin 125 and includes member 126 having a face plate 127. Member 126 has a sleeve 128 attached thereto, which receives adjustable arm 129, carrying restraining face 130, which is retained in sleeve 128 by set screw 131. Sleeve 132 is also mounted on member 126, and arm 133 is retained therein by set screw 134. Arm 133 retains longitudinal member 2 against longitudinal movement, and restraining face 127 restrains end member 81 against longitudinal movement.

Figure 9:
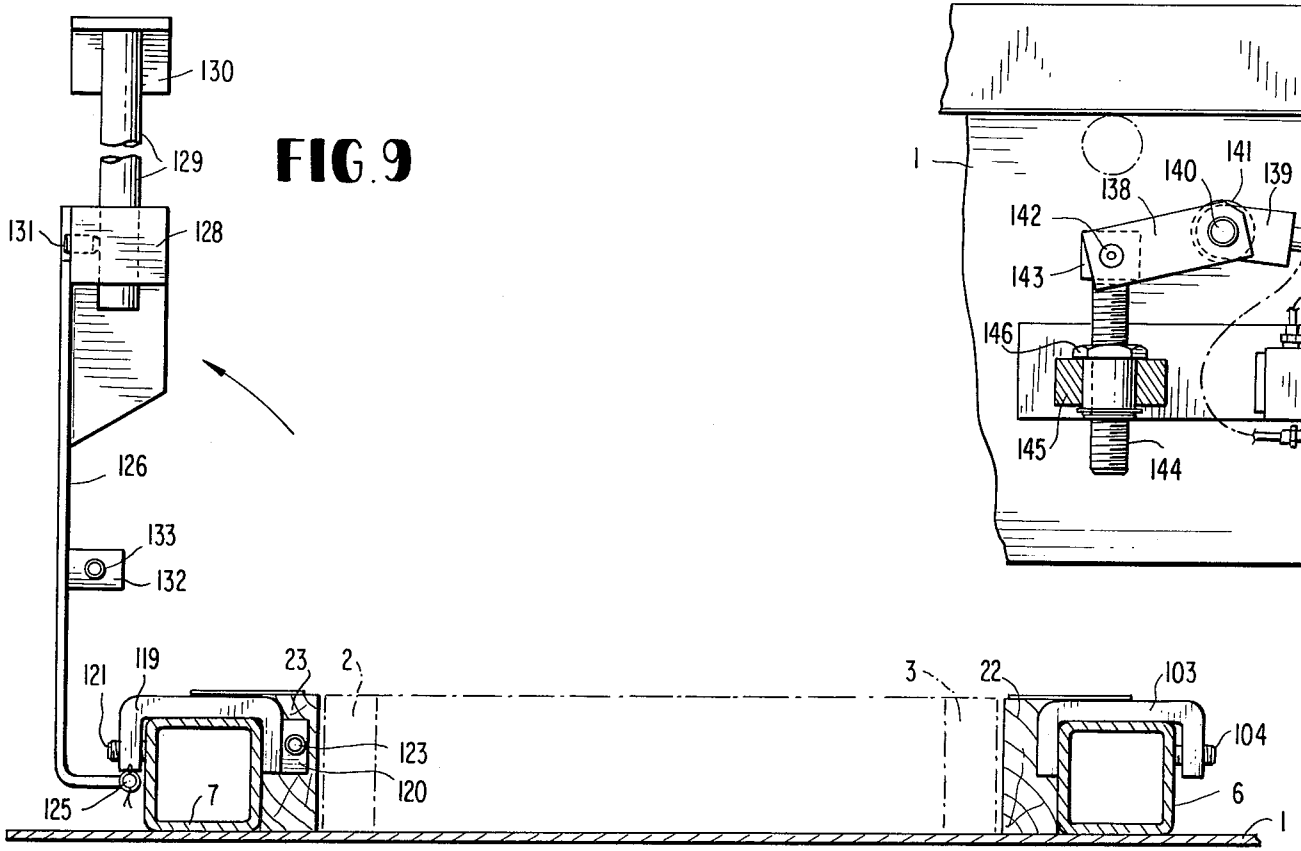
FIG. 9 is an end view, along line 9—9 of FIG. 7, of the jig table, illustrating the end locator clamp swung out of the way.
Figure 13:
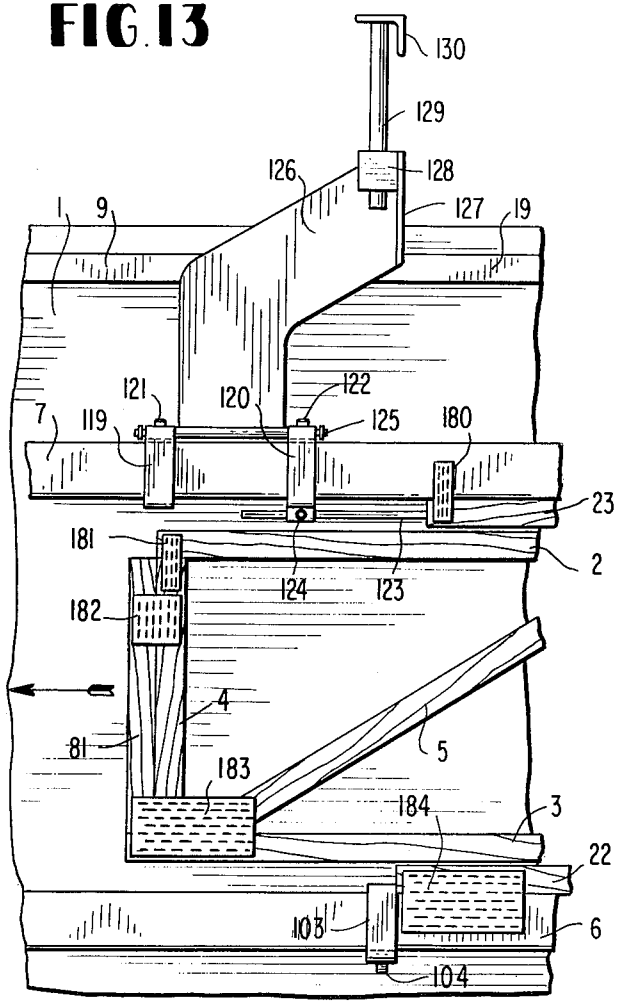
FIG. 13 is an overhead view of one end of the jig table, illustrating the truss being unloaded horizontally past a end locator which has been pivoted out of the way.

Most of end clamp 9 is pivotable about pin 125, as will be readily noted from examination of FIGS. 9 and 13, which illustrate end clamp 9 in two different positions of pivotable movement about pin 125.

FIG. 7 illustrates air clamp 14 in the extended position thereof, wherein jig tube 6 is pressed into restraining engagement with the truss being assembled.

Figure 10:
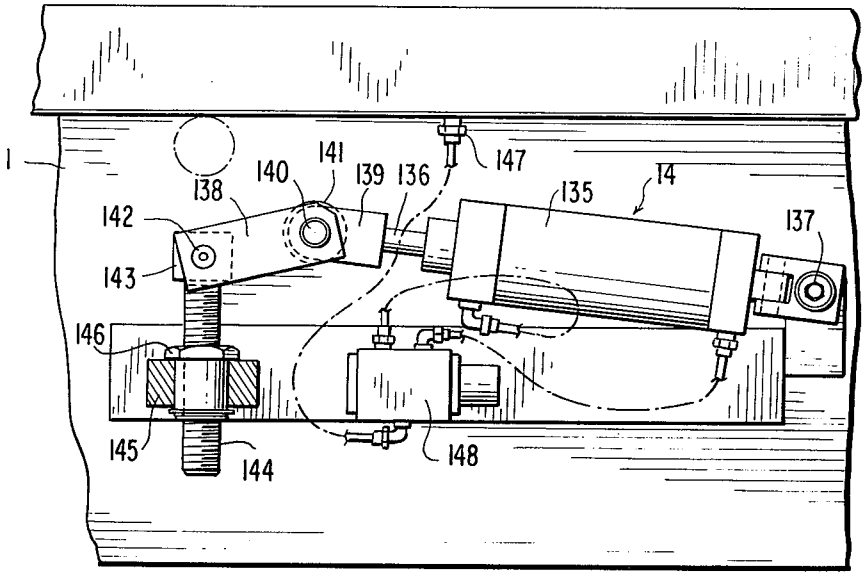
FIG. 10 is an overhead view of the air clamp in the retracted position.

FIG. 10 illustrates air clamp 14 in the retracted position, wherein jig tube 6 no longer exerts restraining pressure against the truss being assembled. Air clamp 14 will be more clearly understood with reference to FIGS. 7, 8 and 10. The air clamp 14 includes cylinder 135 and piston 136 slidable therein. The cylinder end of the piston/cylinder assembly is pivotably fastened by bolt 137 to jig table 1. The end of the piston 136 furthest removed from cylinder 135 is pivotably connected to linkage 138 by fitting 139 and pin 140. Fitting 139 includes roller wheel 141 (seen more clearly in FIG. 8). Linkage 138 is connected through pin 142 to fitting 143 which is connected through threaded adjustable member 144 to sleeve 145 welded to jig table 1. Adjusting nut 146 permits threaded adjustable member 144 to be adjusted in relation to sleeve 145, and thus through linkage 138 the position of roller 140 may be adjusted to a predetermined restraining position.

Cylinder 135 is a fluid actuated cylinder, preferably a pneumatic cylinder operated by compressed air. A convenient supply location for the compressed air is through jig tube 6, with the air being supplied to the jig tube 6 by conduit 27. An air supply fitting 147 will be provided for each air clamp 14, with the air supplied to air valve 148 and from air valve 148 to either end of the piston within cylinder 135 as desired.

It will be noted from FIGS. 7 and 8 that when the piston 136 is in its extended position, roller 141 has been moved into restraining engagement with jig tube 6. At this position the linkage 138 is aligned with threaded adjustable member 144 so that thrusts which arise during the pressing operation are resisted by a relatively rigid, straight assembly between sleeve 145 and jig tube 6. This is in contrast to the prior art procedure of resisting such forces directly by an air-actuated cylinder, and the prior art procedures have been plagued by problems arising from movement of jig tube 6 during the actual pressing operation. In this regard, it will be appreciated that the pressing operation can exert considerable lateral forces upon the truss restraining assembly.

Jig tube 6 is preferably in two separate sections, one on either side of center line 6, so that one section can be subjected to limited movement while the other section is in rigid, restraining position. For this reason, it is preferred that the jig tube 6 contains two separate air chambers 149, 150 which may be interconnected by tubing 151.

Jig tube 7 is restrained against lateral movement by camber adjustment member 15. Camber adjustment member 15 includes a perforated sleeve 152 which is rigidly attached to the jig table 1, and a tube 153 slidable therein. Tube 153 includes a perforated section 154 and a threaded section 155. Adjustment nuts 156, 157 control the spacing of jig tube 7 in relation to perforated sleeve 152. Tube 153 penetrates jig tube 7 through port 158 therein, and is retained in perforated sleeve 152 by one or more retaining pins 159. The position of retaining pin 159 in preselected perforations in tube perforated section 154 and in perforated sleeve 152 provides a rough adjustment of the camber adjustment assembly 15, and fine adjustments are provided nuts 156, 157. As will be seen in FIG. 1, a plurality of camber adjustment assemblies 15 are provided along the length of the jig table 1, in order to permit construction of a truss having a desired degree of camber therein. It is decidedly preferred that each camber adjustment assembly 15 be located opposite each air clamp 14 in order to prevent undue deformation of the jig tube 6, 7.

Figure 11:
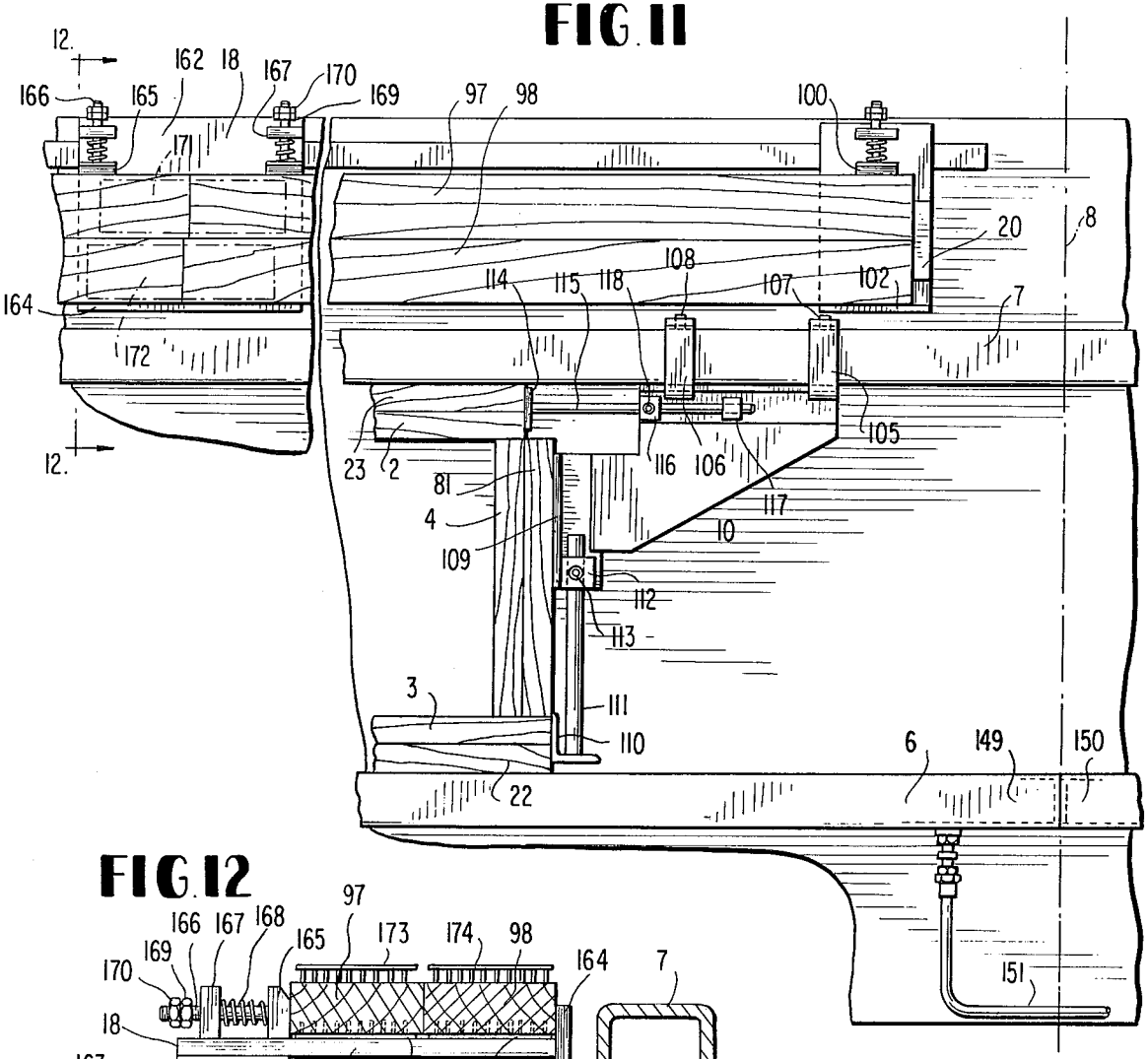
FIG. 11 is an overhead view of the end locator clamp located near the press centerline, and an overhead partial view of the splice pad of the jig table.
Figure 12:
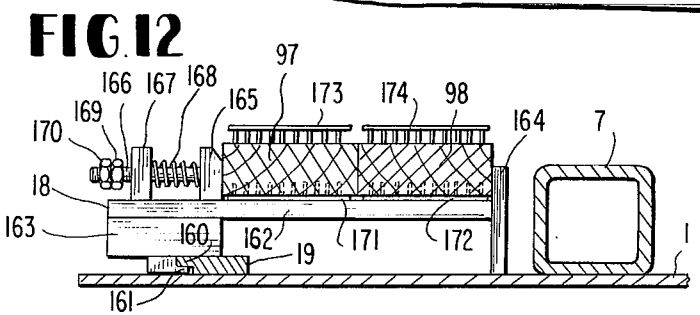
FIG. 12 is a cross-sectional view, taken along line 12—12 of FIG. 11, of the splice pad.

Lumber pieces 97, 98 are restrained during the pressing operation against transverse movement by splice pads 18, which will be seen most clearly in FIGS. 11 and 12. Splice pads 18, as well as clamp pads 24, 25 and stop pads 20, 21 are slidably adjustable along track 19. Track 19 has a lip 160 provided thereon, and a mating lip 161 is provided on splice pad 18. The main horizontal plate 162 of splice pad 18 is elevated above jig table 1 by block 163 extending above lip 162 and by flange 164. The main horizontal plate 162 is elevated so that lumber pieces 97, 98 thereon will pass over, and not interfere with, the camber adjustment assembly 15. Lumber pieces 97, 98 rest upon the upper face of main horizontal plate 162, and are loosely restrained against lateral movement by the upper portion of flange 164 and by spring-loaded clamp member 165. Clamp member 165 has an elongated section 166 extending therefrom, and received in sleeve 167. Clamp member 165 is biased by spring 168, and is retained in sleeve 167 by lock nuts 169, 170. Connector plates 171, 172 shown pressed into the lower face of lumber pieces 97, 98, respectively, in FIG. 12, and connector plates 173, 174 shown in position to be pressed therein, are pressed into lumber pieces in the same pressing cycle.

It will be noted that the upper face of clamp member 165 has a bevel 175 thereon to facilitate insertion into lumber pieces 97, 98 between flange 164 and clamp member 165. Each splice pad 18 has two clamp members 165 thereon, to clamp and restrain the ends of two pieces of lumber which abut at clamp pad 18. Clamping elements 99 and 100 of clamp pad 24 and stop pad 20, respectively, are identical to clamp member 165 and its associated sleeve, elongated section, etc.

Clamp pad 24 includes spring loaded clamping element 99 and flange 101 as described hereinabove. It also includes an adjustable clamp face 176 attached to an elongated member 77 receivable and lockable in sleeve 178 and operable by handle 179.

One important advantage of the press assembly of the present invention is that the trusses produced thereon can be unloaded at either end of the jig table with the truss maintained in a horizontal position. This is illustrated in FIG. 13, which illustrates a truss, which has been formed by a pressing operation just completed, being unloaded by sliding same off of the jig table in the direction of the arrow. Connector plate 180 has been pressed into longitudinal member 23 over connector plate area 90. Likewise, connector plate 181 has been pressed into place in connector plate area 185, connector plate 82 has been pressed into place in connector plate area 84, connector plate 183 has been pressed into position in connector plate area 82, and connector plate 184 has been pressed into place in connector plate area 88.

Figure 14A:
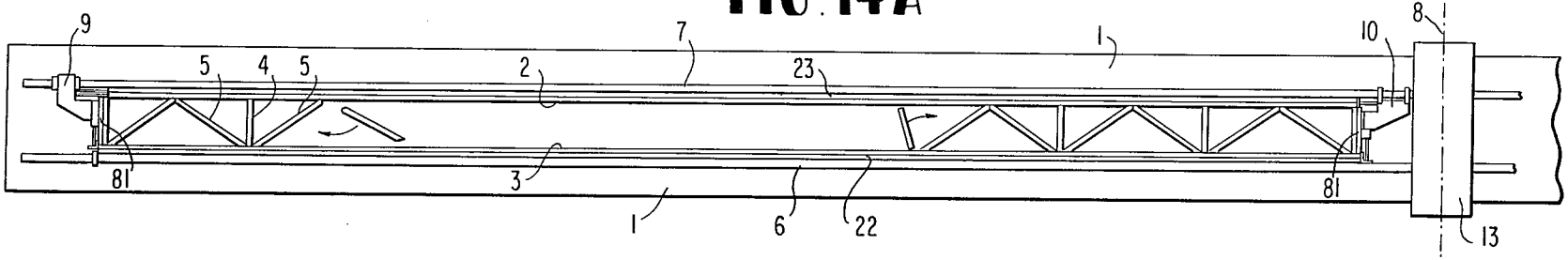
Figure 14B:
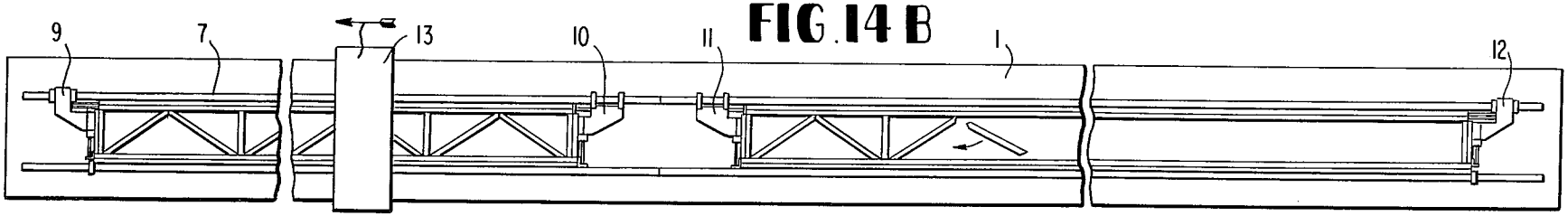

The operation of the press of the present invention will be more clearly understood with reference to FIG. 14A, B, C, and D. In FIG. 14A, press 13 is shown at the center line 8 of jig table 1. Longitudinal members 23, 2, 3, and 22 have been placed between end clamp 10 and end clamp 9. End members 81, perpendicular members 4 and diagonal members 5 are inserted between longitudinal members 2 and 3. Longitudinal members 2, 3 have connector plates pressed into the lower face thereof by a previous press operation, and matching connector plates are placed in appropriate locations, wherein two different pieces of lumber meet, on the top of the truss assembly. Thereafter, press 13 is activated and travels to the left-hand side of jig table 1, as shown by the arrow in FIG. 14B. At this period of time, a second truss is being assembled at the right-hand side of jig table 1. During this period of travel, contact arm 76 contacts stop peg 79 to stop the press 13 and to initiate a pressing operation. A plurality of stop pegs 79 are located along perforated track 31, at each location wherein a pressing operation is desired, and when the press 13 has reached the left-hand end of jig table 1, the truss pressing operation is completed.

Figure 14C:
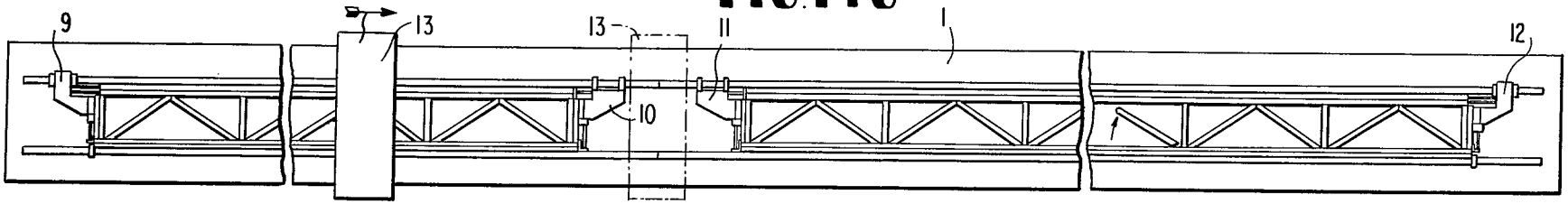
Figure 14D:
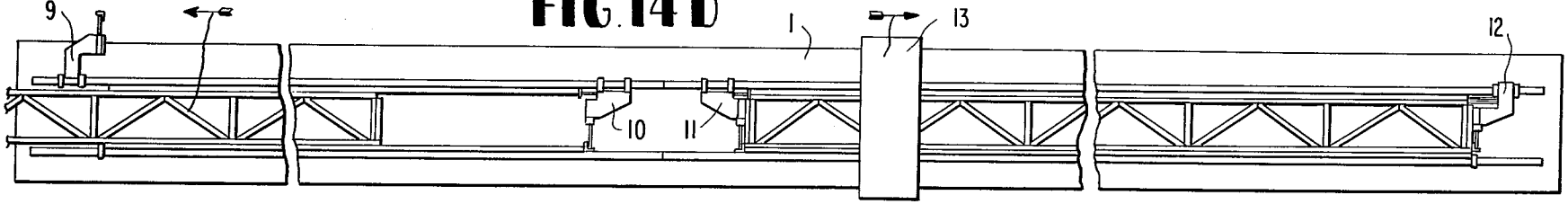

When the press 13 reaches the left-hand end of jig table 1, contact arm 77 contacts stop plate 78, causing a signal to be generated which stops the press and then causes the press to travel from such end back to the center line 8 of the jig table 1 as illustrated in FIG. 14C. Thereupon, the truss which has been built may be removed by retracting air clamps 14, to permit jig tube 6 to retract from restraining engagement with the truss being assembled. End clamp 9 is pivoted about pin 125 so as to move out of the way of the truss during the truss withdrawal step. The truss can then be withdrawn horizontally out the end of the jig table 1, as illustrated in FIG. 14D. As illustrated in that Figure, press 13 has been initiated to start a pressing cycle on the opposite end of jig table 1, wherein the members to form a new truss have been placed into proper position and appropriate connector plates have also been properly located.

Contact arms 75, 76 can pivot toward either end of the jig table when contacting a stop peg 79 or 80 during travel of press 13. However, only one direction of pivotal movement of contact arm 75 or 76 will cause an appropriate press cycle signal to be generated, thereby stopping the press travel and initiating a pressing cycle. Pivotal motion of contact arm 75 in one direction, say the left hand side of FIG. 6, will generate a pressing cycle signal whereas pivotal movement of contact arm 76 to cause a press cycle signal to be generated will be in the opposite direction, say the right hand side of FIG. 6. Stop pegs 79 will be used on one end of the jig table and stop pegs 80 will be used on the opposite table end. Thus, one contact arm will control the pressing cycles at one end of jig table 1, and the other contact arm will control the pressing cycles at the opposite end of jig table 1. When the press 13 is returning from either end of the jig table to centerline 8, the contact arms will contact stop pegs but no press cycle signal will be generated, as the pivotable movement of the contact arm is not in the direction to cause signal generation.

At the same time that the truss was being fabricated on the left-hand side of jig table 1, longitudinal members 22, 23 were having appropriate connector plates pressed thereinto, and then these longitudinal members are removed from the horizontal restrictions imposed by end clamp 10, on the one end, and arm 123 and clamp 103, on the other end. Longitudinal members 22, 23 are then rotated 180 degrees about their longitudinal axis, and in that position are suitable for forming new members 2, 3 of the truss to be assembled in a subsequent pressing operation, wherein again a new set of longitudinal members 22, 23 are utilized.

During the pressing operation, the press is also forming new longitudinal members 22, 23 at one side of the jig table 1. Pieces of lumber 97, 98 are assembled between clamp pad 24 and stop pad 20, and between clamp pad 25 and stop pad 21. At each location wherein a member 97 and/or 98 abuts another piece of lumber, a connector plate will be utilized in order to form a longitudinal member of the desired length. Each such butting area is located over a splice pad 18, and the press 13 is also programmed to stop at appropriate locations over splice pads 18 in order to press the connector plates at such location.

I claim:

1. An assembly suitable for fabricating wooden panels, trusses or the like, from lumber and toothed sheet metal connector plates, said assembly comprising:

(a) a jig table means for supporting said lumber during fabrication;

(b) said jig table means including a pair of opposed jig members for holding said lumber in a predetermined position on said jig table, at least one of said jig members being horizontally retractable away from said lumber;

(c) said one jig member being clampable in position by a plurality of clamp means, said clamp means comprising fluid actuated clamp cylinder means pivotably connected at one end at a first pivot location to said jig table means, a link pivotably connected at one end at a second pivot location to the other end of said clamp cylinder means, an adjustable means pivotably connected at one end at a third pivot location to the other end of said link and adjustably fixed at the other end to said jig table, said clamp means contacting said jig member at said second pivot location, said clamp cylinder means moving said link from a first link position in clamping contact with said jig member to a second link position retracted from clamping contact with said jig member, said link and said adjustable means cooperating to provide a rigid, incompressible clamping linkage between said jig table and said jig member when said link is in said first link position;

(d) press means to press the teeth of said connector plates into said lumber, said press means comprising a base structure including a first press platen, a head including a second press platen in opposition to said first press platen, a link means supporting said head above said base structure at least two bellcrank means mounted upon said head on opposite sides of said press, a transfer bar means interconnecting said bellcrank means, a fluid actuated press cylinder means connecting said head and a bellcrank means, and guide means for guiding said second press platen in generally vertical movement above said first press platen, said bellcrank, said transfer bar means, said press cylinder means, and said guide means cooperating to move said second press platen means in the desired, generally vertical direction above said first press platen means while maintaining said platen means in a generally parallel relationship; and (e) moving means to move said press means relative to lumber on said jig table means.

2. A press suitable for use in fabricating wooden panels, trusses or the like comprising:

a base structure including a first press platen;

a head including a second press platen in opposition to said first press platen;

at least two bellcrank means mounted upon said head on opposite sides of said press;

a transfer bar interconnecting said bellcrank means to effect parallel movement of said bellcrank means upon movement of either one of at least said two bellcrank means;

a fluid actuated press cylinder means being connected directly between said head and at least one of said bellcrank means;

guide means for guiding said second press platen during generally vertical movement in relation to said first press platen;

said bellcrank means, said transfer bar, said press cylinder means and said guide means cooperating to move said second press platen in the desired generally vertical direction in relation to said first press platen while maintaining said first and second platen in a generally parallel relationship; and each of said bellcrank means includes an upper portion being pivotably connected to said transfer bar, a lower portion pivotably connected to said head, a link means having one end pivotably connected to said lower portion of said bellcrank means and another end connected to said base structure, and said fluid actuated press cylinder means being connected to said upper portion of one of said bellcrank means.

3. The press according to claim 2 wherein each of said bellcrank means include two pair of lower lobes defined by the lower portion of said bellcrank means, a first pair of lower lobes being displaced from a second pair of lower lobes along a longitudinal axis, said upper portion of said bellcrank means extending upwardly from a position intermediate said first pair and said second pair of said lower lobes and being fixed thereto.

4. The press according to claim 3 wherein said link means are support links and each of said support links is adjustably secured to said base structure to adjust the height of said link relative to said base structure thereby permitting the press to handle varying thicknesses of materials to be fabricated.

5. The press according to claim 4 wherein a top end is defined by the upper portion of each of said bellcrank means and said transfer bar being pivotably secured to said top end.

6. An assembly suitable for fabricating wooden panels, trusses or the like, from lumber and toothed sheet metal connector plates, said assembly comprising:

(a) jig table means for supporting said lumber during fabrication;

(b) press means to press the teeth of said connector plates into said lumber, said press means comprising a base structure including a first press platen, a head including a second press platen in opposition to said first press platen, a link means supporting said head above said base structure, a means for moving said second press platen in opposition to said first press platen to press said plates into said lumber;

(c) moving means to move said press platen means relative to said lumber on said jig table means;

(d) said jig table means including at least one jig member for holding said lumber in position, said jig member being clampable in position by a plurality of clamp means, said clamp means including a fluid actuated clamp cylinder means movable between an extended position for holding said jig member in position in a retracted position for unclamping said jig member, said clamp means further including a rigid member secured to said jig table means and a movable member movable between an engaged position where said movable member engages said jig member and said rigid member to impart the thrust from said jig member to said rigid member for holding said jig member in place and a disengaged position where said movable member is disengaged from said jig member, said movable member being integrated with said fluid actuated clamp cylinder means whereby movement of said clamp cylinder means to said extended position moves said movable member to said engaged position and movement of said clamp cylinder means to a retracted position moves said movable member to a disengaged position where said jig member is not restrained.

7. The assembly according to claim 6 wherein said fluid actuated clamp cylinder means is a pneumatic cylinder having a piston therein, said piston having one end moving within said cylinder for actuation by pneumatic means and another end connected to said movable member.

8. The assembly according to claim 7 wherein said moving member is a link having one end pivotably secured to said rigid member and the other end secured to said piston.

9. The assembly according to claim 8 wherein said rigid member is adjustable toward and away from said jig member for adjusting the position of said movable member for engaging said jig member.

10. The assembly according to claim 9 wherein said adjustable rigid member includes a threaded bolt, a threaded sleeve with said bolt being threadedly secured thereto, an adjusting nut for securing said threaded bolt within said threaded sleeve at a predtermined position, said threaded bolt having another end pivotably secured to said movable member.

11. The assembly according to claim 10 wherein said cylinder has one end opposite said end with said piston connected to said link member pivotably secured to said jig table.

12. The assembly according to claim 11 wherein said link member carries a roller for engaging and disengaging said jig member whereby actuation of said cylinder moves said piston to said extended position which in turn moves said link and said roller to an engaged position where said roller engages said jig member to provide a substantially rigid linkage between said rigid member and said jig member for absorbing thrust forces imparted during pressing of said plates to hold said jig member and said lumber in place, and withdrawing said piston member to move said link with said roller out of engagement with said jig member to withdraw restraining means imparted to said jig member allowing said lumber to be moved once said press operation has been completed.

* * * * *